US012150597B2

(12) United States Patent
Liberatore

(10) Patent No.: US 12,150,597 B2
(45) Date of Patent: Nov. 26, 2024

(54) MAGNETIC TOWEL HOLDER

(71) Applicant: Paul Liberatore, Chandler, AZ (US)

(72) Inventor: Paul Liberatore, Chandler, AZ (US)

( * ) Notice: Subject to any disclaimer, the term of this patent is extended or adjusted under 35 U.S.C. 154(b) by 0 days.

(21) Appl. No.: 18/199,875

(22) Filed: May 19, 2023

(65) Prior Publication Data

US 2023/0371758 A1 Nov. 23, 2023

Related U.S. Application Data

(60) Provisional application No. 63/344,003, filed on May 19, 2022.

(51) Int. Cl.

| | |
|---|---|
| ***A63B 57/60*** | (2015.01) |
| ***A47K 10/14*** | (2006.01) |
| ***A63B 57/30*** | (2015.01) |
| ***A63B 57/35*** | (2015.01) |

(52) U.S. Cl.

CPC ..... *A47K 10/14* (2013.01); *A63B 57/35* (2015.10); *A63B 57/353* (2015.10)

(58) Field of Classification Search

CPC ..... A47K 10/14; A63B 57/35; A63B 57/353; A63B 55/408; A63B 57/20; A63B 57/60; A63B 57/207; A63B 2209/08

See application file for complete search history.

(56) References Cited

U.S. PATENT DOCUMENTS

| | | | | |
|---|---|---|---|---|
| 2001/0037542 | A1* | 11/2001 | Elliott | A63B 57/60 24/3.11 |
| 2013/0323457 | A1* | 12/2013 | Barringer | A47K 10/02 428/134 |
| 2019/0060724 | A1* | 2/2019 | Farina | A63B 60/36 |
| 2022/0241660 | A1* | 8/2022 | Nalla | A63B 57/60 |
| 2023/0211215 | A1* | 7/2023 | Erdman | A63B 55/408 206/315.3 |

* cited by examiner

*Primary Examiner* — Amy J. Sterling

(74) *Attorney, Agent, or Firm* — Wright Law Group, PLLC; Mark F. Wright

(57) ABSTRACT

An apparatus for selectively attaching and removing a golf towel from a golf bag, golf club, or other metal surface comprises a magnetic holder that can be inserted through an aperture formed in a golf towel or other similar object. The magnetic holder comprises a multi-part body with a threaded portion that connects two body portions where the threaded portion is configured be inserted through the aperture and secured in place via matching threads. The magnetic holder further comprises one or more ball marking devices that are magnetically attached to the magnetic holder, where the ball marking devices can be selectively detached from the magnetic holder and used to mark a desired golf ball location.

9 Claims, 4 Drawing Sheets

MAGNETIC TOWEL HOLDER

BACKGROUND OF THE INVENTION

1. Technical Field

This invention relates generally to golfing and more specifically relates to an apparatus and method to attach a golf towel or similar item to a golf club or golf bag.

2. Background Art

Golfing is a pastime enjoyed by people all over the world. In addition to golf clubs, golf balls and tees, many golfers carry additional equipment with them during their golf outings to make the golfing experience more enjoyable and efficient.

For example, many golfers carry items to clean their golf balls and golf clubs during their round so as to achieve the best possible result by removing grass, dirt, and other debris from the golf ball and the clubs. One such item is a golf towel.

Many golf towels are manufactured from a material such as terry cloth and may also comprise an aperture formed in a corner of the golf towel, thereby allowing the golfer to attach the golf towel to the golf bag by means of a clip or carabiner. This allows the golfer to have ready access to the towel when needed.

While this approach has been successful, it will typically require the golfer to use two hands to remove the golf towel from the bag. In order to obviate this procedure, some golf towels are manufactured with a magnet embedded in the fabric of the towel, thereby allowing the towel to be magnetically attached to metal components on the golf bag or even to the head of a golf club.

However, many golf towels are manufactured without an embedded magnet. Further, the cost of a golf towel with an embedded magnet is typically significantly higher than a golf towel without an embedded magnet. This means that many golfers are left with older and less desirable methods of affixing their golf towel to their golf bag or golf clubs. Accordingly, without additional improvements in the state of the art for affixing golf towels to a golf bag or golf club, the use of golf towels will continue to be sub-optimal.

BRIEF SUMMARY OF THE INVENTION

An apparatus for selectively attaching and removing a golf towel from a golf bag, golf club, or other metal surface comprises a magnetic holder that can be inserted through an aperture formed in a golf towel. The magnetic holder comprises a multi-part body with a threaded portion that can be inserted through the aperture and secured in place via matching threads. The magnetic holder further comprises one or more ball marking devices that are magnetically attached to the magnetic holder.

BRIEF SUMMARY OF THE FIGURES

The various preferred embodiments of the present invention will hereinafter be described in conjunction with the appended drawings, wherein like designations denote like elements, and.

DETAILED DESCRIPTION OF THE INVENTION

An apparatus for selectively attaching and removing a golf towel from a golf bag, golf club, or other metal surface comprises a magnetic holder that can be inserted through an aperture formed in a golf towel. The magnetic holder comprises a multi-part body with a threaded portion that can be inserted through the aperture and secured in place via matching threads. The magnetic holder further comprises one or more ball marking devices that are magnetically attached to the magnetic holder.

Figure 1:
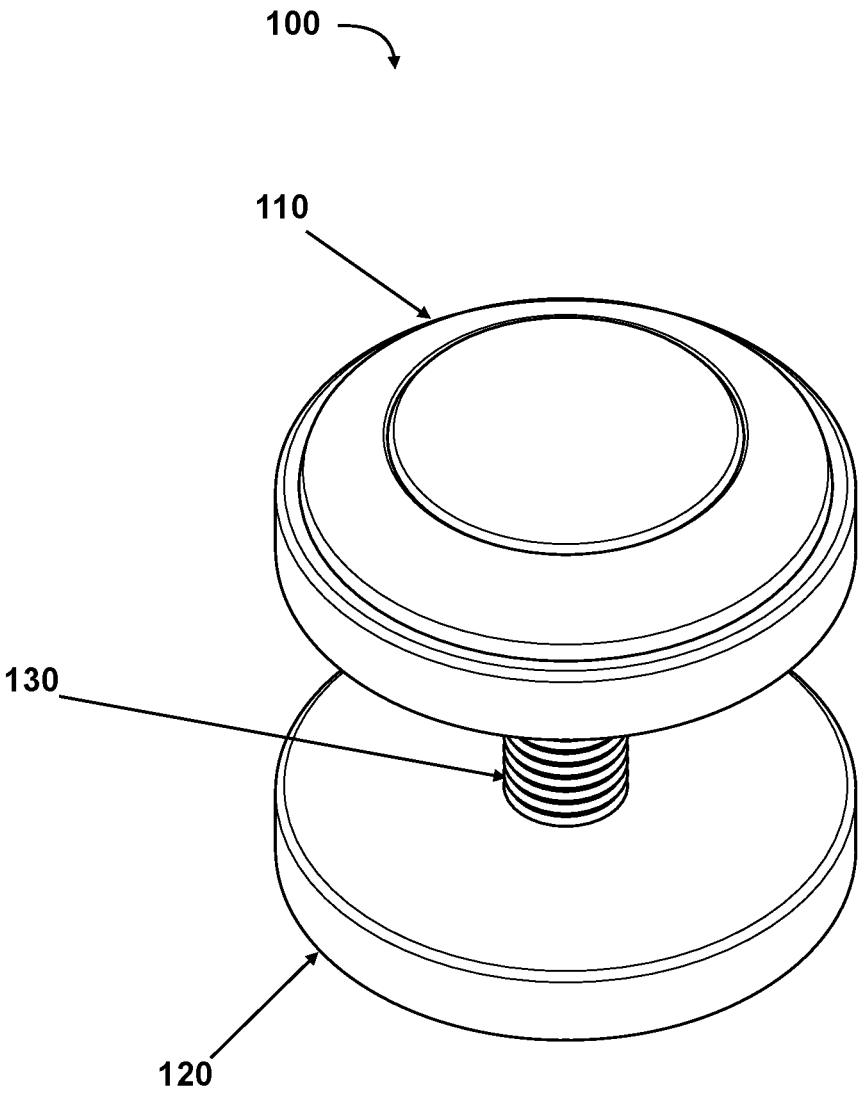
FIG. 1 is a perspective view of a magnetic towel holder in accordance with a preferred exemplary embodiment of the present invention.

Referring now to FIG. 1, a perspective view of a magnetic towel holder 100 in accordance with a preferred exemplary embodiment of the present invention is depicted. As shown in FIG. 1, magnetic towel holder 100 comprises two main body components, a first body component 110 and second body component 120. Body component 110 and body component 120 may be joined together by using threaded portion 130. In the most preferred embodiments of the present invention, body component 110 and body component 120 are manufactured from a ferromagnetic material and, accordingly, can be affixed to metal objects via magnetic force (e.g., magnetic attraction between two charged objects as a consequence of electromagnetic force).

Figure 2:
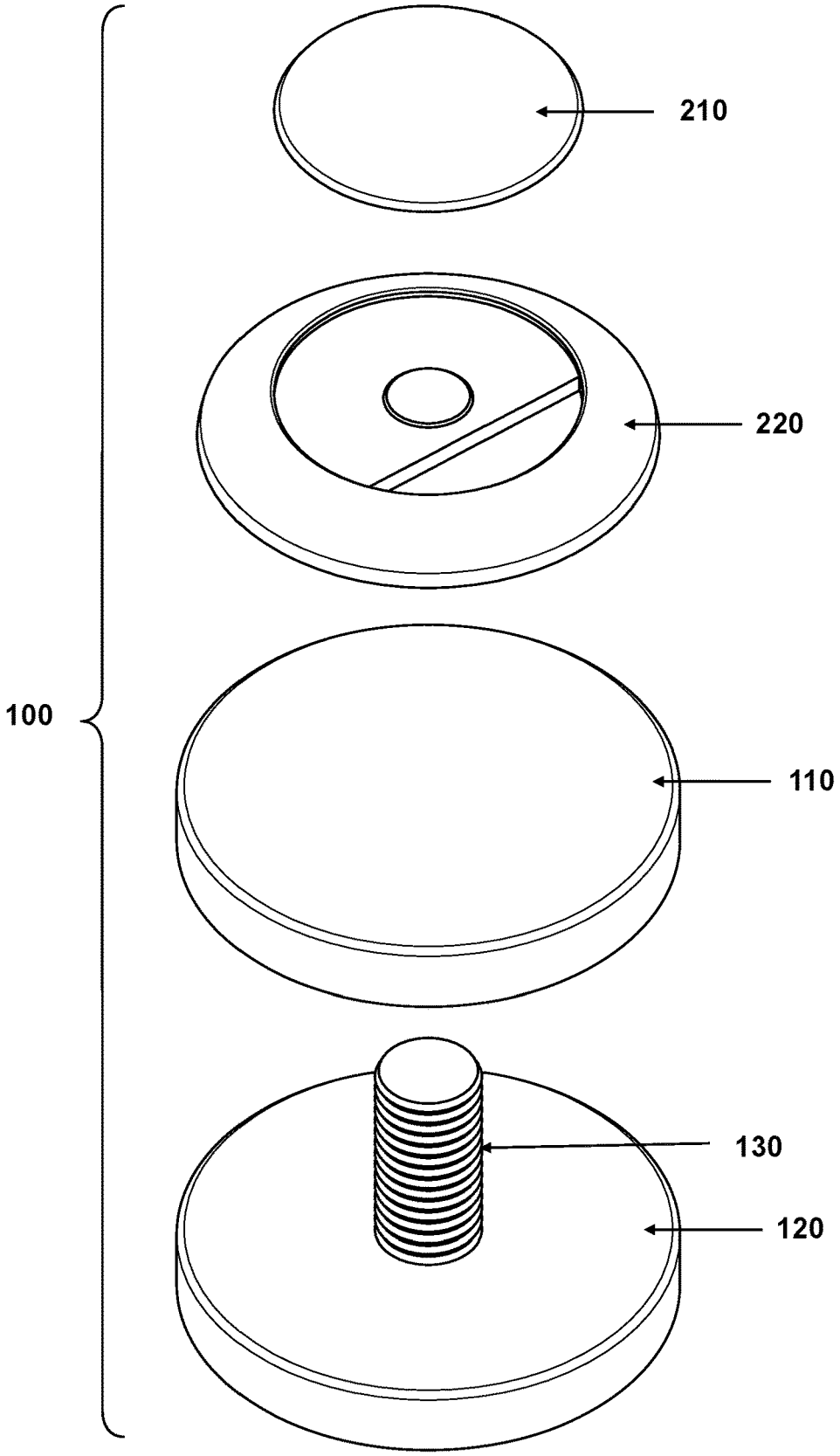
FIG. 2 is an exploded perspective view of a magnetic towel holder in accordance with a preferred exemplary embodiment of the present invention.

Referring now to FIG. 2, an exploded perspective view of a magnetic towel holder 100 in accordance with a preferred exemplary embodiment of the present invention is depicted. As shown in FIG. 2, body component 110 and body component 120 may be selectively connected to each other by inserting the threads of threaded portion 130 into an appropriately configured threaded aperture in body component 110. Similarly, body component 110 and body component 120 may be selectively disconnected by reversing this threading process.

Additionally, the most preferred embodiments of magnetic towel holder 100 further comprises a first removable marker 220 and a second removable marker 210. Marker 210 and marker 220 can be used in a variety of situations, such as marking the location of a golf ball on the putting green. In the most preferred embodiments of the present invention, removable ball marker 220 is manufactured from a ferromagnetic material and is removable attached to the surface of either of body component 110 or body component 120 via magnetic attraction.

In the most preferred embodiments of the present invention, removable ball marker 210 is manufactured from a metallic material that is magnetically active, meaning that removable ball marker 210 may be removably attached to the surface of removable ball marker 220 via magnetic attraction. Additionally, in at least one preferred embodiment of the present invention, removable ball marker 210 is sized to fit snugly inside a recessed portion of removable ball marker 220. Additionally, in the most preferred embodiments of the present invention, ball marker 210 has a flat surface that may be used for displaying a logo or other branding information which is useful in specialty marketing applications.

Figure 3:
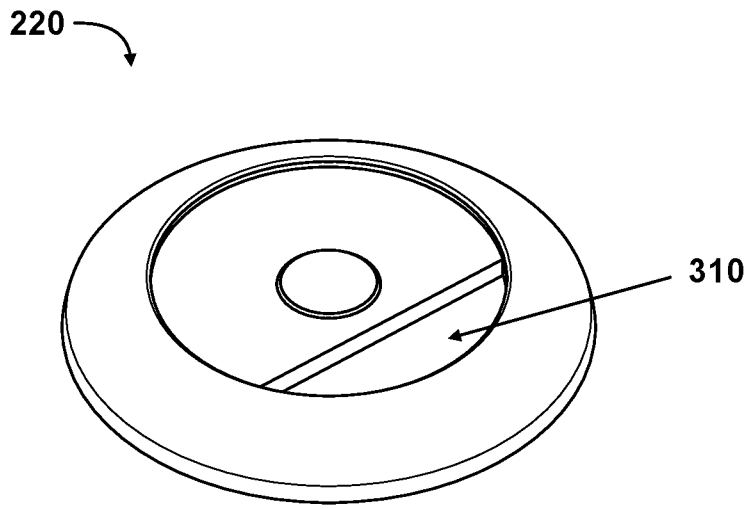
FIG. 3 is a perspective view of a selectively removable marker used in conjunction with a preferred exemplary embodiment of the present invention.

Referring now to FIG. 3, a perspective view of a selectively removable ball marker 220 used in conjunction with a preferred exemplary embodiment of the present invention is depicted. As shown in FIG. 3, removable ball marker 220 is manufactured with a "step down" or detent portion 310. This allows removable ball marker 210 to be easily separated from removable ball marker 220. In this embodiment, the top of removable ball marker 210 is flush with the top of removable ball marker 220.

Figure 4:
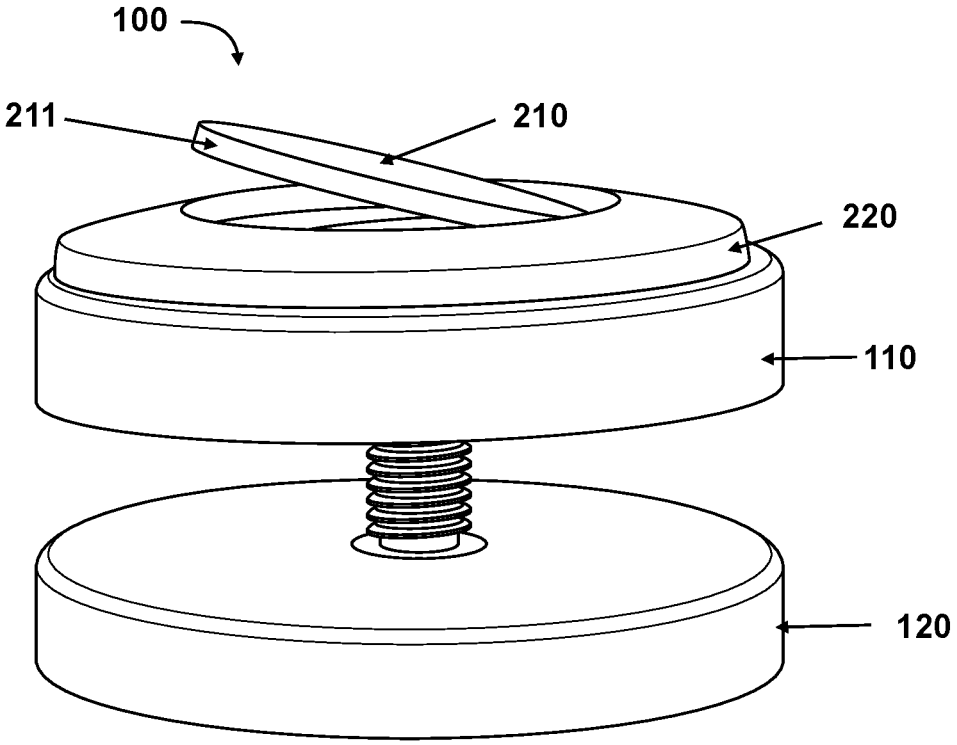
FIG. 4 is a perspective view of a selectively removable marker positioned for removal from a magnetic towel holder in accordance with a preferred exemplary embodiment of the present invention.

Referring now to FIG. 4, a perspective view of a selectively removable ball marker positioned for removal from a magnetic towel holder in accordance with a preferred exemplary embodiment of the present invention is depicted. As shown in FIG. 4, an edge portion of removable ball marker 210 that lies over "step down" or detent portion 310 has been pushed down or depressed and is now recessed into "step down" or detent portion 310. This action causes edge portion 211 to be lifted up, creating a grasping surface and making it easy for a golfer to grasp edge portion 211 and to remove removable ball marker 210 from removable ball marker 220.

As previously discussed, removable ball marker 220 can be selectively detached from body component 110 by overcoming the magnetic attraction between removable ball marker 220 and body component 110. This can be accomplished by simply sliding body component 110 off of body component 110. Once removable ball marker 210 and removable ball marker 220 have been removed from body component 110 and separated from each other, they may be used to mark the location of a golf ball on the green.

In order to affix magnetic towel holder 100 to a golf towel, body component 110 and body component 120 are separated by unscrewing body component 110 and body component 120. Then, threaded portion 130 can be inserted through an aperture in a golf towel and body component 110 and body component 120 can be connected again by screwing body portion body component 110 into body component 120. Given that body component 110 and body component 120 are both manufactured from a ferromagnetic material, the magnetic attraction between magnetic towel holder 100 and a metal surface on a golf bag or the metal surface of a golf club will provide a simple way to removably attached the golf towel to golf bag or the metal surface of a golf club (e.g., the head of the golf club). This will allow the golfer to have quick and easy access to the golf towel when needed.

In summary, it will be understood that even though certain aspects of the present specification are highlighted by referring to one or more specific embodiments, those skilled in the art will readily appreciate that these disclosed embodiments are only illustrative of the principles of the subject matter disclosed herein. Therefore, it should be understood that the disclosed subject matter is in no way limited to a particular methodology, protocol, and/or material, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of the present disclosure, which is defined solely by the claims. Accordingly, embodiments of the present disclosure are not limited to those precisely as shown and described herein.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, or term so qualified encompasses a reasonable range above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should be construed in light of the number of reported significant digits and by applying ordinary rounding techniques.

Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the disclosed embodiments (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the embodiments otherwise claimed. No language in the present specification should be construed as indicating any non-claimed element essential to the practice of the disclosed embodiments. Accordingly, the scope of the invention should be determined not by the embodiment(s) illustrated, but by the appended claims and their legal equivalents.

The invention claimed is:

1. A method of using a magnetic towel holder and a towel, the method comprising the steps of:

inserting a threaded portion of the magnetic towel holder though an aperture formed in the towel;

detachably connecting a first body portion of the magnetic towel holder to a second body portion of the magnetic towel holder by engaging a plurality of threads in the threaded portion with one of the first body portion of the magnetic towel holder and the second body portion of the magnetic towel holder, thereby selectively attaching the towel to the magnetic towel holder, wherein the first body portion and the second body portion are manufactured from a ferromagnetic material; and placing the magnetic towel holder in close proximity to a metal object, thereby using magnetic attraction to attach the magnetic towel holder to the metal object.

2. The method of claim 1 further comprising the step of removing a first marker from the magnetic towel holder, the first marker being selectively attached to the magnetic towel holder via magnetic attraction.

3. The method of claim 1 wherein the metal object is one of a golf bag or golf club, thereby allowing for selective removal of the towel to and from the metal object.

4. The method of claim 1 further comprising the step of removing a second marker from the magnetic towel holder, the second marker being selectively attached to the first marker via magnetic attraction.

5. The method of claim 1 further comprising the steps of:

removing a first marker from the magnetic towel holder, the first marker being selectively attached to the magnetic towel holder via magnetic attraction; and removing a second marker from the magnetic towel holder, the second marker being selectively attached to the first marker via magnetic attraction.

6. The method of claim 5 wherein the second marker is contained within the first marker.

7. The method of claim 5 wherein the second marker is positioned over a recessed portion of the first marker and the second marker is removed by pressing on a surface of the second marker so as to force an edge of the second marker into the recessed portion of the first marker, thereby creating a grasping surface for removing the second marker from the first marker.

8. The method of claim 5 wherein:

the second marker is contained within the first marker; and wherein the second marker is positioned over a recessed portion of the first marker and the second marker is removed by pressing on a surface of the second marker so as to force an edge of the second marker into the recessed portion of the first marker, thereby creating a grasping surface for removing the second marker from the first marker.

9. The method of claim 5 wherein each of the first marker and the second marker are used to mark the location of a golf ball on a putting green.

* * * * *